US009637203B1

(12) United States Patent
Kirwan-Waterson

(10) Patent No.: US 9,637,203 B1
(45) Date of Patent: May 2, 2017

(54) DETACHABLE CURTAIN THAT SECURES TO A BOAT COVER

(71) Applicant: Mary Ellen Kirwan-Waterson, Allen, TX (US)

(72) Inventor: Mary Ellen Kirwan-Waterson, Allen, TX (US)

( * ) Notice: Subject to any disclaimer, the term of this patent is extended or adjusted under 35 U.S.C. 154(b) by 0 days.

(21) Appl. No.: 15/150,134

(22) Filed: May 9, 2016

Related U.S. Application Data

(60) Provisional application No. 62/160,950, filed on May 13, 2015.

(51) Int. Cl.
*B63B 17/02* (2006.01)

(52) U.S. Cl.
CPC ..... *B63B 17/02* (2013.01)

(58) Field of Classification Search
CPC ..... B63B 17/00; B63B 17/02; B63B 17/023
USPC ..... 114/361
See application file for complete search history.

(56) References Cited

U.S. PATENT DOCUMENTS 6,848,387 B1 * 2/2005 Zalanka ..... B63B 17/02 114/361
2010/0218714 A1 * 9/2010 Withers ..... B63B 17/02 114/361
2014/0130728 A1 * 5/2014 Parniske ..... B63B 17/02 114/361

* cited by examiner

*Primary Examiner* — Lars A Olson
(74) *Attorney, Agent, or Firm* — Plager Schack LLP

(57) ABSTRACT

A detachable curtain coupled to a cover of a boat includes a pliable netting panel, a first sheet member coupled to the top edge of the netting panel and having a first pouch, a second sheet member coupled to the top edge of the netting panel and having a second pouch, a first set of fasteners coupled to the first sheet member and embedded within the first pouch, and a second set of fasteners coupled to the second sheet member and embedded within the second pouch. The netting panel is maneuvered to permit both the first and second sheet members to surround a portion of the boat's cover, thereby permitting the first set of fasteners to engage with the second set of fasteners to support the netting panel in an upright position.

7 Claims, 5 Drawing Sheets

DETACHABLE CURTAIN THAT SECURES TO A BOAT COVER

RELATED APPLICATION

The application claims priority to provisional patent application U.S. Ser. No. 62/160,950 filed on May 13, 2015, the entire contents of which is herein incorporated by reference.

BACKGROUND

The embodiments herein relate generally to curtains or shade devices that enhance privacy and protect individuals from the sun's rays.

Individuals on boats are often exposed to the sun. Many boats such as fishing, cruising and pontoon boats comprise a flexible cover or bimini top secured above the boat by a frame. Although these covers and tops are effective at preventing light from reaching individuals when the sun is directly overhead, these tops are not effective when the sun is positioned at the sides of the boat.

Several shades and/or visors exist for use with boats. However, these devices are limited because: 1) they do not easily attach or detach from the boat, 2) they cannot be adjusted easily to different angles to maximize sun blockage and user privacy, and/or 3) they do not permit air to pass through the shade to create a natural, pleasant and open environment for the user.

As such, there is a need in the industry for a detachable curtain for use with a boat that addresses the limitations of the prior art, which effectively attaches to the boat's cover to enhance user privacy and sun blockage.

SUMMARY

A detachable curtain coupled to a cover of a boat is provided. The curtain is configured to block sunlight and permit air to pass therethrough. The detachable curtain comprises a pliable netting panel comprising a top edge, a bottom edge opposite the top edge and side edges connecting the top and bottom edges, a first sheet member coupled to the top edge of the netting panel, the first sheet member comprising a first folded region comprising an end of the first sheet member coupled to an intermediate portion of the first sheet member to create a first pouch, a second sheet member coupled to the top edge of the netting panel, the second sheet member comprising a second folded region comprising an end of the second sheet member coupled to an intermediate portion of the second sheet member to create a second pouch, a first set of fasteners coupled to the first sheet member and embedded within the first pouch, and a second set of fasteners coupled to the second sheet member and embedded within the second pouch, wherein the netting panel is maneuvered to permit both the first and second sheet members to surround a portion of the cover of the boat, thereby permitting the first set of fasteners to engage with the second set of fasteners to support the netting panel in an upright position.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
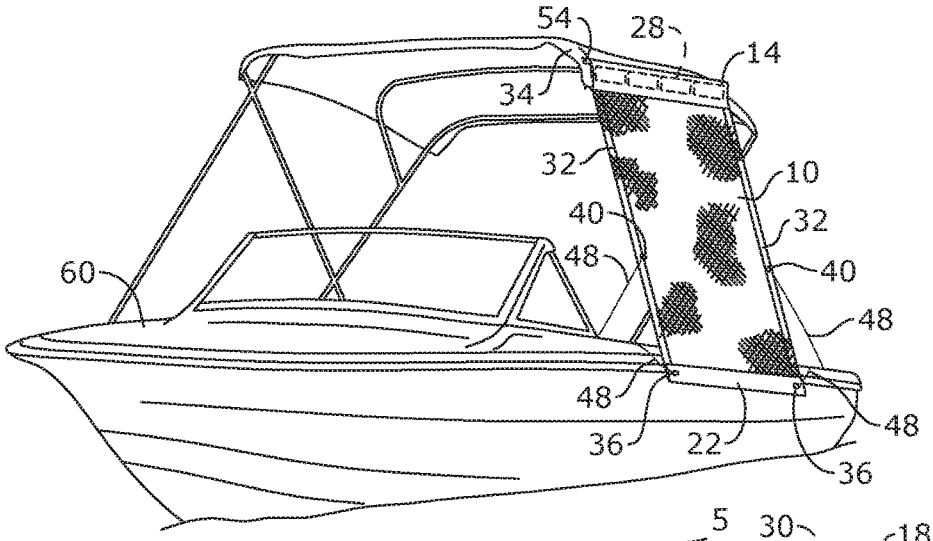
FIG. 1 depicts a perspective view of certain embodiments of the detachable curtain shown in use coupled to a boat cover.

As depicted in FIGS. 1-4, the detachable curtain is configured for use with boat 60. In a preferred embodiment, the detachable curtain is secured to boat cover 34 and tied to a stationary object by cord 48. The stationary object may include, but is not limited to, a structural member of the boat's frame such as a post or anchor, or a weighted object on the boat's deck such as a cooler, storage compartment, or the like. The detachable curtain generally comprises netting panel 10, front sheet member 14, rear sheet member 18, front sheet magnets 28, rear sheet magnets 30, and bottom band 22.

Figure 3:
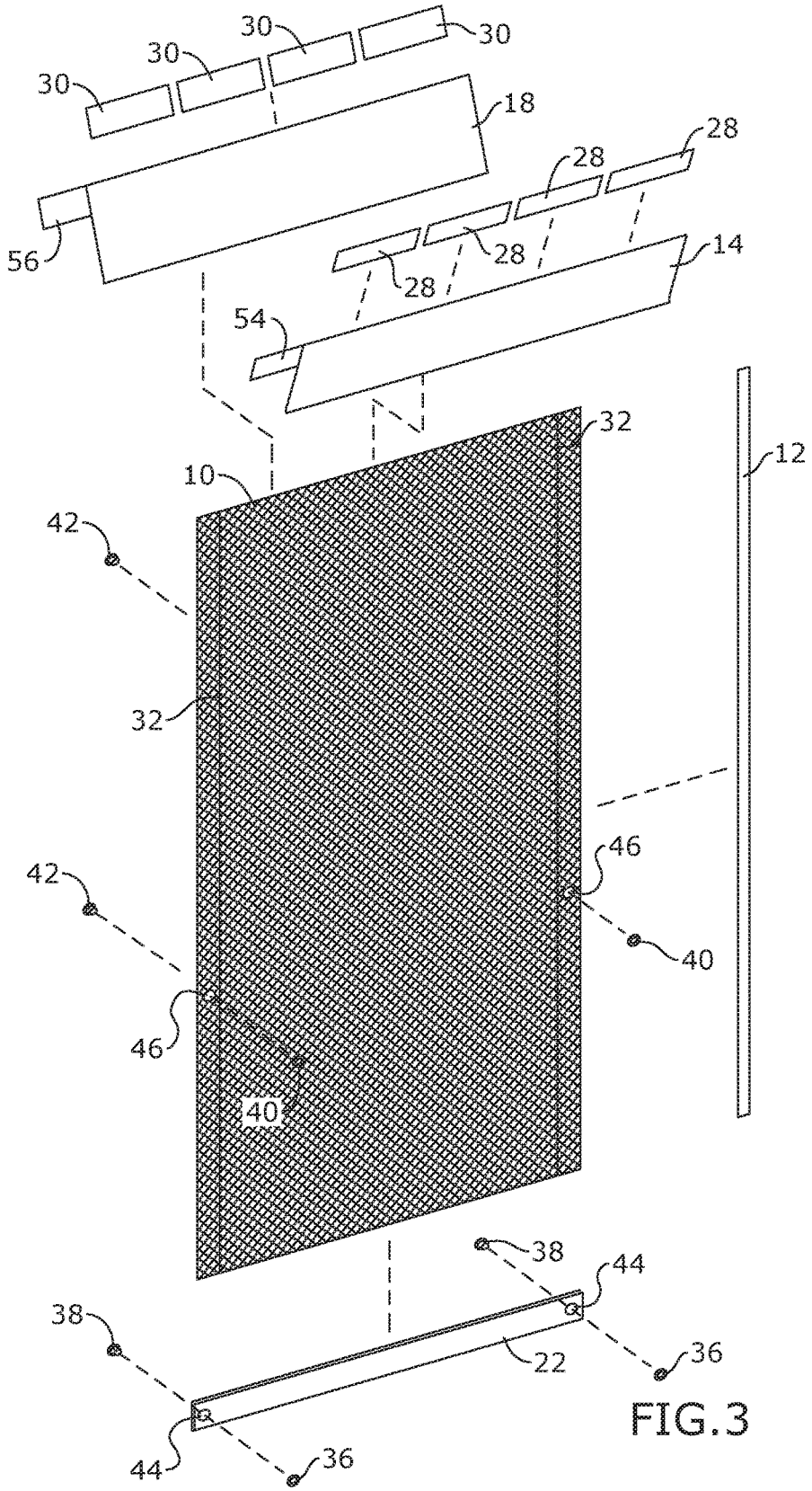
FIG. 3 depicts an exploded view of certain embodiments of the detachable curtain.

As depicted in FIG. 3, netting panel 10 is a generally pliable rectangular mesh with a plurality of holes each approximately 2-3 mm wide. However, the size of each hole in netting panel 10 may vary to conform to the user's requirements. In a preferred embodiment, netting panel 10 is made from polyester or an alternative synthetic fiber. This material permits netting panel 10 to block and/or reduce the transmission of sunlight through the panel. At the same time, the panel's holes permit air to pass through, which creates a natural, pleasant and open environment for the user.

The side edges of netting panel 10 comprise side seams 32, which reinforce the edges. In one embodiment, each side seam 32 may comprise a structural band (not shown) embedded within a folded over portion of netting panel 10, which is sewn to itself. The structural band extends along the entire side seam 32 of netting panel 10. Likewise, bottom band 22 is sewn to the bottom edge of netting panel 10 to reinforce the edge.

In certain embodiments, a pair of upper apertures 46 is disposed through side seams 32 along intermediate portions of the netting panel's side edges. Each upper aperture 46 on side seam 32 is configured to receive a grommet, which comprises upper grommet post 42 and upper grommet cap 40. Upper grommet post 42 and upper grommet cap 40 snap together within upper aperture 46 in side seam 32. Similarly, a pair of lower apertures 44 is disposed through bottom band 22. Each lower aperture 44 in bottom band 22 is configured to receive a grommet, which comprises lower grommet post 38 and lower grommet cap 36. Lower grommet post 38 and lower grommet cap 36 snap together within each lower aperture 44 in bottom band 22.

Figure 4:
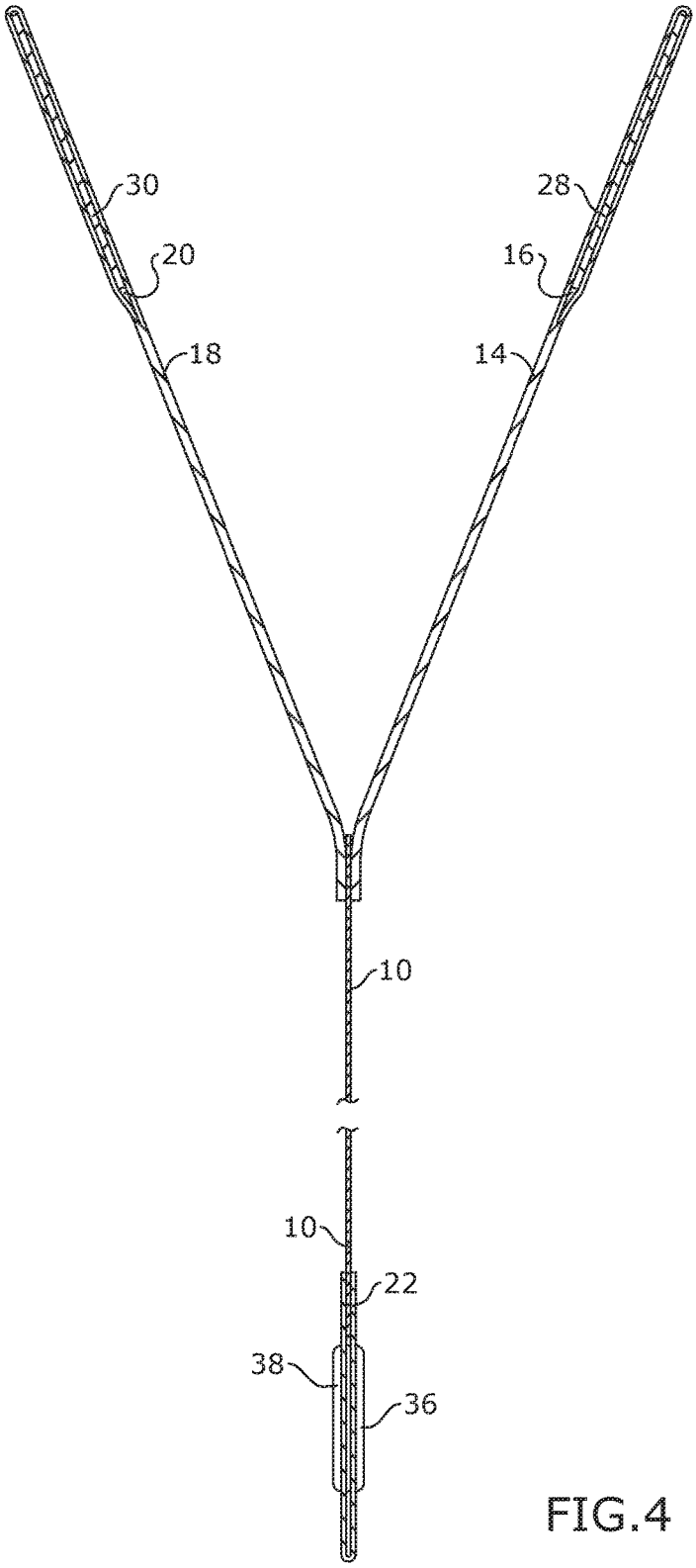
FIG. 4 depicts a section view of certain embodiments of the detachable curtain taken along line 4-4 in FIG. 2.

Front sheet member 14 is a generally rectangular band that is sewn to the top edge of netting panel 10. A plurality of front magnets 28 is preferably sewn to front sheet member 14. As depicted in FIG. 4, the upper end of front sheet member 14 is folded over front magnets 28 and sewn to an intermediate portion of front sheet member 14 to create front pouch 16. In this configuration, front magnets 28 are embedded within front pouch 16 and positioned along the upper fold line. Similarly, rear sheet member 18 is a generally rectangular band that is sewn to the top edge of netting panel 10. A plurality of rear magnets 30 is preferably sewn to rear sheet member 18. The upper end of rear sheet member 18 is folded over rear magnets 30 and sewn to an intermediate portion of rear sheet member 18 to create rear pouch 20. In this configuration, rear magnets 30 are embedded within rear pouch 20 and positioned along the upper fold line. In this configuration, front and rear sheet members 14, 18 form a generally V-shaped configuration that can be adjusted to permit front magnets 28 to detachably couple with rear magnets 30. In a preferred embodiment, front and rear sheet members 14, 18 are made from a durable canvas material. However, alternative materials known in the field may be used instead.

In operation, the detachable curtain is secured to boat 60 as shown in FIG. 1. Front and rear sheet members 14, 18 are oriented to surround a portion of boat cover 34. Front and rear sheet members 14, 18 are pressed together to permit front magnets 28 in front sheet member 14 to engage with rear magnets 30 in rear sheet member 18. This secures the detachable curtain to boat 60 in an upright position. To further secure the curtain in place, cord 48 may be disposed through any number of the grommets located on the curtain and tied to a structural member of boat 60 and/or a weighted object on the boat's deck. In one embodiment, cord 48 is made from nylon. However, alternative material cords may be used instead.

To remove the detachable curtain from boat 60, cord 48 is loosened and removed from the curtain. Front and rear sheet members 14, 18 are pulled apart to disengage front magnets 28 from rear magnets 30. In one embodiment, front tab 54 is sewn to an end of front sheet member 14. Similarly, rear tab 56 is sewn to an end of rear sheet member 18. Front and rear tabs 54, 56 provide surfaces for a user (not shown) to grab to make it easier to separate front and rear sheet members 14, 18. In a preferred embodiment each tab of front and rear tabs 54, 56 is made from heavy-duty nylon webbing.

Figure 2:
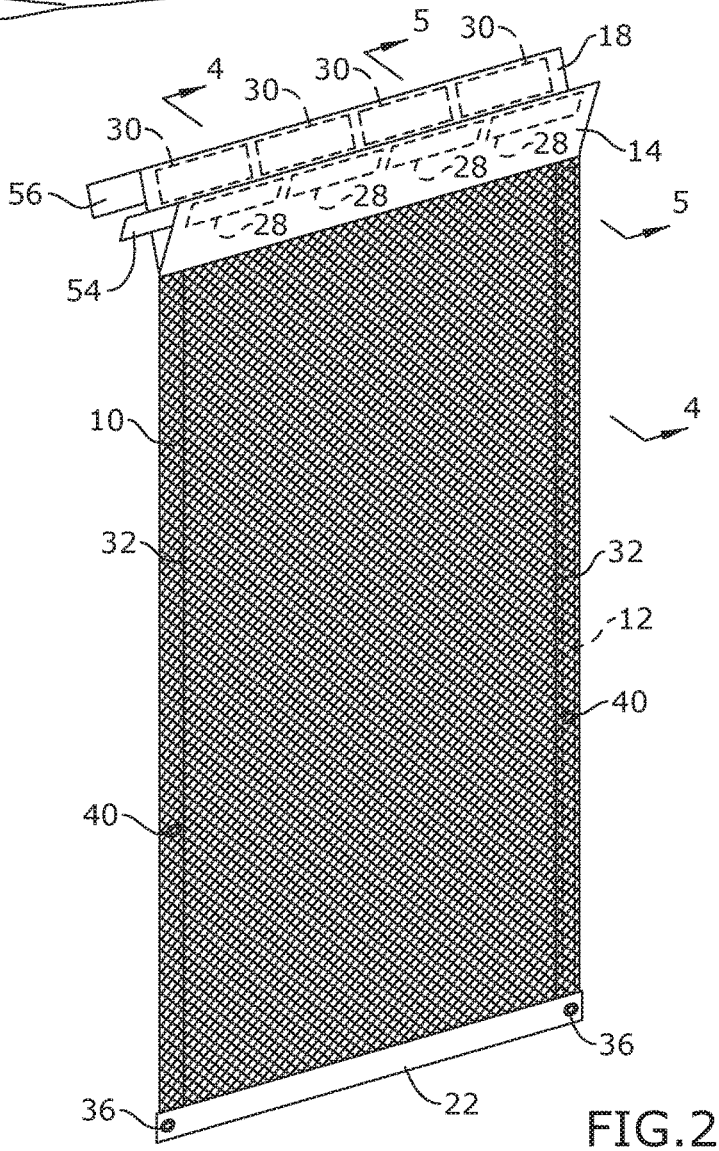
FIG. 2 depicts a perspective view of certain embodiments of the detachable curtain.
Figure 5:
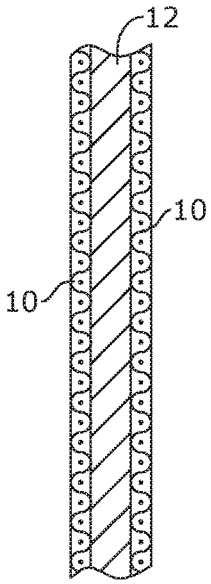
FIG. 5 depicts a section view of certain embodiments of the detachable curtain taken along line 5-5 in FIG. 2.

In an alternative embodiment, magnetic tape strip 12 is embedded within netting panel 10 and positioned to extend along one of side seams 32 as depicted in FIGS. 2 and 5. This configuration is advantageous in certain applications where two detachable curtains are mounted on a boat side by side (not shown), such as on a pontoon boat. The pair of adjacent curtains can be detachably coupled together by engaging magnetic tape strips 12 of the curtains. This permits a user (not shown) to easily separate the adjacent curtains to create an entryway when desired. It shall be appreciated that magnetic tape strip 12 is not required and may be non-existent in certain embodiments.

Figure 6:
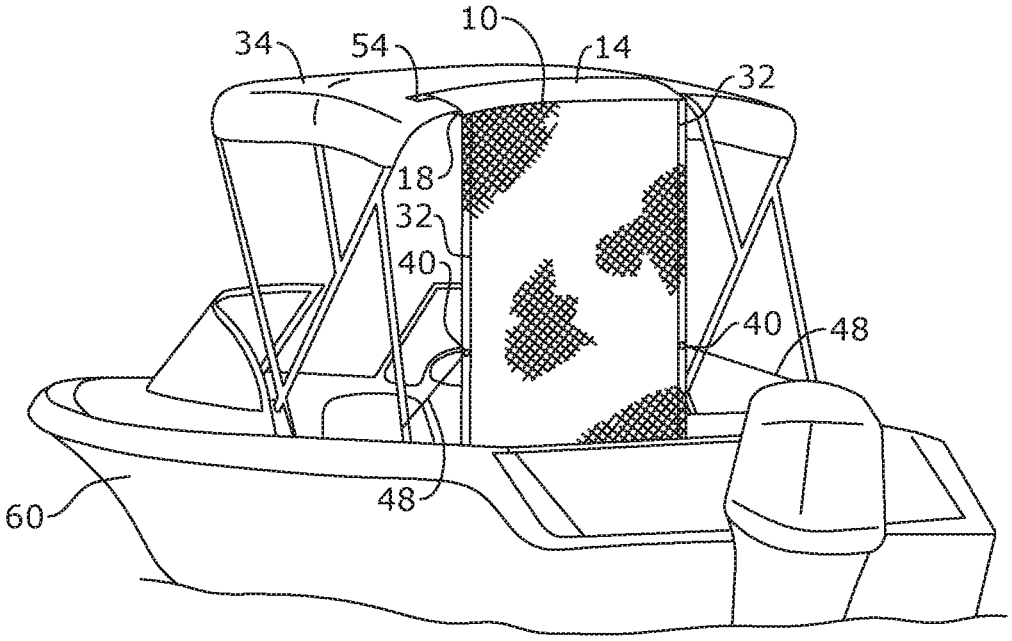
FIG. 6 depicts a perspective view of certain embodiments of the detachable curtain in an alternative use.
Figure 7:
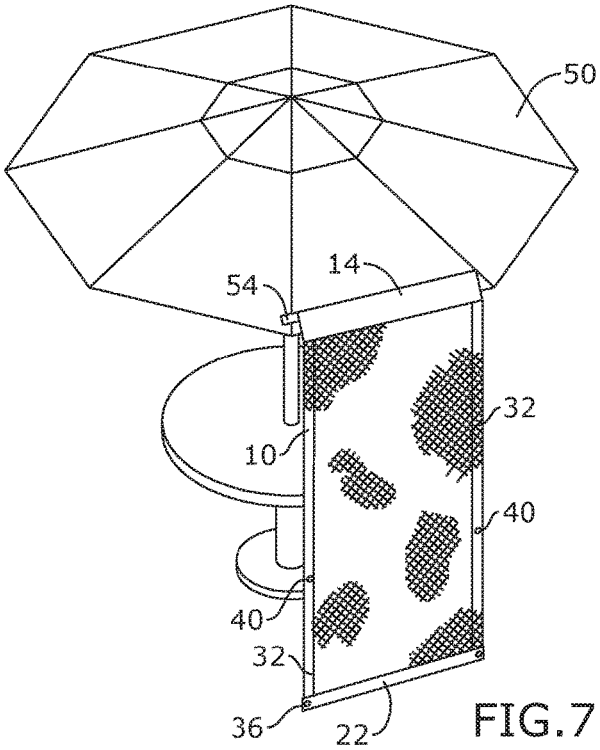
FIG. 7 depicts a perspective view of certain embodiments of the detachable curtain in an alternative use.
Figure 8:
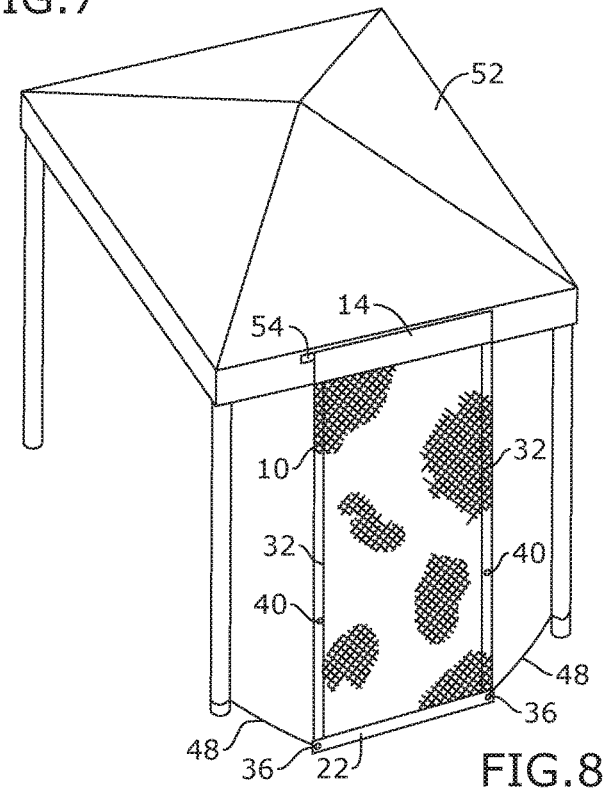
FIG. 8 depicts a perspective view of certain embodiments of the detachable curtain in an alternative use.

The detachable curtain may be secured to boat 60 at different locations. For example, FIG. 1 depicts the detachable curtain secured to a side portion of boat cover 34. FIG. 6 depicts the detachable curtain secured to a rear portion of boat cover 34. It shall be appreciated that the detachable curtain is not limited for use with boats, but may be used in any alternative applications where sun blockage and enhanced privacy are desired. FIG. 7 depicts the detachable curtain secured to umbrella 50. FIG. 8 depicts the detachable curtain secured to awning 52.

It shall be appreciated that the components of the detachable curtain described in several embodiments herein may comprise any alternative known materials in the field and be of any color, size and/or dimensions. It shall be appreciated that the components of the detachable curtain described herein may be manufactured and assembled using any known techniques in the field.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A detachable curtain coupled to a cover of a boat, the curtain configured to block sunlight and permit air to pass therethrough, the detachable curtain comprising:

a pliable netting panel comprising a top edge, a bottom edge opposite the top edge and side edges connecting the top and bottom edges;

a first sheet member coupled to the top edge of the netting panel, the first sheet member comprising a first folded region comprising an end of the first sheet member coupled to an intermediate portion of the first sheet member to create a first pouch;

a second sheet member coupled to the top edge of the netting panel, the second sheet member comprising a second folded region comprising an end of the second sheet member coupled to an intermediate portion of the second sheet member to create a second pouch;

a first set of fasteners coupled to the first sheet member and embedded within the first pouch; and a second set of fasteners coupled to the second sheet member and embedded within the second pouch;

wherein the netting panel is maneuvered to permit both the first and second sheet members to surround a portion of the cover of the boat, thereby permitting the first set of fasteners to engage with the second set of fasteners to support the netting panel in an upright position.

2. The detachable curtain of claim 1, wherein the first set of fasteners comprises a first set of magnets and the second set of fasteners comprises a second set of magnets, wherein the magnets in the first set are positioned along a fold line in the first folded region, wherein the magnets in the second set are positioned along a fold line in the second folded region.

3. The detachable curtain of claim 2, further comprising a lower band coupled to the bottom edge of the netting panel.

4. The detachable curtain of claim 3, further comprising a first pair of grommets coupled to the lower band and the netting panel.

5. The detachable curtain of claim 4, further comprising a second pair of grommets coupled to the netting panel and positioned at opposing side edges of the netting panel.

6. The detachable curtain of claim 5, further comprising a cord disposed through any number of grommets in the first and second pair of grommets, wherein the cord is configured to be coupled to a stationary object on the boat.

7. The detachable curtain of claim 6, further comprising a magnetic strip coupled to the netting panel and extending along one of the side edges of the netting panel.

* * * * *